US011030982B1

(12) United States Patent
Monjardo

(10) Patent No.: US 11,030,982 B1
(45) Date of Patent: Jun. 8, 2021

(54) LIGHTWEIGHT GUITAR BODY HAVING PRISMATIC EFFECT AND IMPROVED SOUND QUALITY AND METHOD OF PRODUCING THEREOF

(71) Applicant: Tajine Monjardo, Great Barrington, MA (US)

(72) Inventor: Tajine Monjardo, Great Barrington, MA (US)

( * ) Notice: Subject to any disclaimer, the term of this patent is extended or adjusted under 35 U.S.C. 154(b) by 0 days.

(21) Appl. No.: 16/695,891

(22) Filed: Nov. 26, 2019

(51) Int. Cl.
*G10D 3/22* (2020.01)
*G10D 1/08* (2006.01)

(52) U.S. Cl.
CPC ..... *G10D 1/085* (2013.01); *G10D 3/22* (2020.02)

(58) Field of Classification Search
CPC ..... G10D 1/085; G10D 3/22
See application file for complete search history.

(56) References Cited

U.S. PATENT DOCUMENTS

2007/0163420 A1* 7/2007 Reiss ..... G10D 1/085 84/329

* cited by examiner

*Primary Examiner* — Kimberly R Lockett
(74) *Attorney, Agent, or Firm* — Andrew S. Langsam; Pryor Cashman P.C.

(57) ABSTRACT

A guitar body of a guitar composed of acrylic material can be modified to produce a highly visual and aesthetic prismatic effect in which white light entering the front of the guitar body can be seen as many separate colors. By applying dichroic paint and primer to precision cuts made into the interior cavity of the acrylic base, colors can be generated by the white light exiting the front of the guitar body. Further, the guitar body may be comprised of different materials for its filler core (forming a sandwich of tonal wood and foam) which cause the guitar to be lightweight, while simultaneously enhancing the sound quality of the guitar.

20 Claims, 6 Drawing Sheets

LIGHTWEIGHT GUITAR BODY HAVING PRISMATIC EFFECT AND IMPROVED SOUND QUALITY AND METHOD OF PRODUCING THEREOF

TECHNICAL FIELD

The present application relates to a lightweight guitar body having a prismatic visual effect and improved sound quality and a method of producing such a guitar body, in particular, the prismatic effect is caused by making carvings in a workpiece comprising acrylic material and coating and filling in the carvings, and the improved sound quality is caused by the combination of the materials present in the guitar body, according to the process set forth herein. The guitar body is, nevertheless, not too heavy even though formed with acrylic, paint and primer, along with a wood interior as part of the interior is formed of foam.

BACKGROUND

In conventional acoustic guitars, plucking, strumming or striking strings of the guitar causes the strings to vibrate. The energy of the vibrating string is sound waves and their energy is transferred to a sound box (i.e. hollow body of the guitar) which in turn amplifies the sound of the vibrating strings and projects the sound outwardly away from the guitar body. This principal also applies to electric guitars that have a hollow or semi-hollow body. On the other hand, a solid body electric guitar is constructed with a solid core such that the solid body electric guitar lacks a sound box. Because the body of the solid body electric guitar is solid (and not hollow), the lack of a sound box prevents the vibrating string in the solid body electric guitar from being amplified. As such, an electric guitar includes an electric pickup which allows a solid body electric guitar to produce amplified sound corresponding to the plucked or struck strings of the guitar. More specifically, the pickup is a device that senses (or captures) mechanical vibrations produced by the strings of the electric guitar and converts such vibrations into an electrical signal. The electrical signals may be transmitted to an instrument amplifier (connected to the electric guitar by wire or cable), which produces amplified sounds through a loudspeaker.

Nevertheless, the solid body electric guitar provides advantages over its non-solid body counterparts (i.e. acoustic guitar, hollow and semi-hollow electric guitars). The solid body electric guitar is basically immune to the issue of acoustic feedback. Acoustic feedback is a positive loop gain which occurs when a sound loop exists between an audio input and an audio output. Acoustic feedback initially commences when the guitar produces sounds, which are in turn amplified by the loudspeaker. The soundwaves from the loudspeaker strikes the hollow body of the guitar, causing the body to resonate. The resonating body causes the guitar strings to vibrate, which are picked up by the pickup device. The loudspeaker, via the pickup(s), in turn cause the sound to be amplified, which strike the hollow body of the guitar again, thereby creating a perpetual loop. As such, because the solid body electric guitar is not hollow, the issue of acoustic feedback is minimized if not eliminated.

However, the solid core of a solid body electric guitar may cause the guitar itself to be heavy for the musician playing the solid body electric guitar. This may pose an even greater problem when the musician is continuously playing on stage for a long time (e.g., 2 hours or more). Further, just as with any instrument, sound quality is an important aspect of the performance. In addition, because a live solo or band performance includes a visual component just as much as an auditory one, the electric guitar being played by the musician could also be visually appealing. Even if the electric guitar performs functionally well or has superb sound, it may not be utilized if the electric guitar is visually unsightly.

SUMMARY

In general, in one aspect, exemplary embodiments of the present invention provide a prismatic and highly visually unique and attractive guitar body of a guitar comprising: an acrylic body including: a top surface and an interior cavity including an interior front facing surface having one or more flawless cuts, wherein layers of dichroic paint and primer are coated on the one or more flawless cuts to produce a prismatic visual effect as the guitar is seen from the front; showing a first distinct set of colors when the front or top surface is viewed from a first viewing angle and a second and distinct set of colors when the front or top surface is viewed from a second viewing angle, and a filler core disposed in the cavity of the acrylic body, the filler core including a first section including a first preferably wooden material and a second section including a second material that is relatively lightweight, like foam. Implementations of the various exemplary embodiments of the present application may include one or more of the following features. The acrylic body is in the shape of a regular acoustic or electric guitar body. The cavity is coated with paint and primer. Then, the filler core is placed into the cavity and adapted to neatly fit within the cavity of the acrylic body. An epoxy resin is coated over the back or the bottom surface of the filler core. The acrylic cavity and the filler core are carved to produce many individual smaller cavities or compartments for holding components of the electric guitar. The entire outside surface of the prismatic guitar body is sanded and polished. In one exemplary embodiment, the first material and the second material which fill up the cavity (after primer and paint are provided to the interior front of the guitar) are the same. In another exemplary embodiment, the first material and the second material (wood and foam) are different from each other. For example, the first material of the filler core can be wood. In another example, the second material of the filler core is rigid but lightweight foam.

In general, in one aspect, exemplary embodiments of the present invention provide a method for creating a prismatic guitar body of a guitar, the method comprising: (a) providing an acrylic guitar shaped yet cavity containing workpiece, (b) carving the workpiece so as to create an acrylic body having a front or top smooth surface and an interior, front facing, bottom surface, separated from the front surface by a small thickness of acrylic, wherein the interior bottom surface is carved by high speed CNC machines with cutting heads doing the milling such that one or more flawless and geometric cuts are created, (c) coating said flawless cuts with a thin layer of dichroic paint, and then (d) coating the layer of dichroic paint with a layer of primer to produce a prismatic visual effect as viewed from the front of the guitar, showing a first distinct set of colors when said top or front surface is viewed from a first viewing angle and a second and distinct set of colors when said top or front surface is viewed from a second viewing angle, (e) carving a filler core from one or more materials; and (f) fitting the filler core into the guitar body cavity and within the flawless cuts in the interior of the guitar body.

Implementations of the various exemplary embodiments of the present application may include one or more of the following features. The acrylic body is in the shape of a conventional guitar body. The filler core is adapted to neatly fit within the cavity of the acrylic body. The method further comprises (g) coating a layer of epoxy resin over a bottom surface of the filler core and then sanding and finishing the same so that the front and the rear of the guitar is smooth and attractive. The method further comprises (h) carving the acrylic cavity and the filler core to produce one or more individual compartments for holding components of an electric guitar. The method further comprises (i) sanding, polishing and/or finishing an entire surface of the prismatic guitar body. In one exemplary embodiment, the first material and the second material are the same i.e., the filler core is substantially a wood material which fits into the cavity of the acrylic body. In another exemplary embodiment, the first material is wood and the second material is lighter-weight or density foam, and, thus clearly is a different material from the wood component of the core filler. For example, the first material of the filler core is wood. In another example, the second material of the filler core is a rigid foam. In the preferred embodiment, the wood component of the filler runs along the longitudinal axis of the guitar (parallel to the strings) while the foam component is located toward the outside edges of the curves of the guitar body.

BRIEF DESCRIPTION OF THE DRAWINGS

The aforementioned and other aspects, features and advantages can be more readily understood from the following detailed description with reference to the accompanying drawings wherein.

DETAILED DESCRIPTION OF THE PREFERRED EMBODIMENTS AND FIGURES

Figure 1:
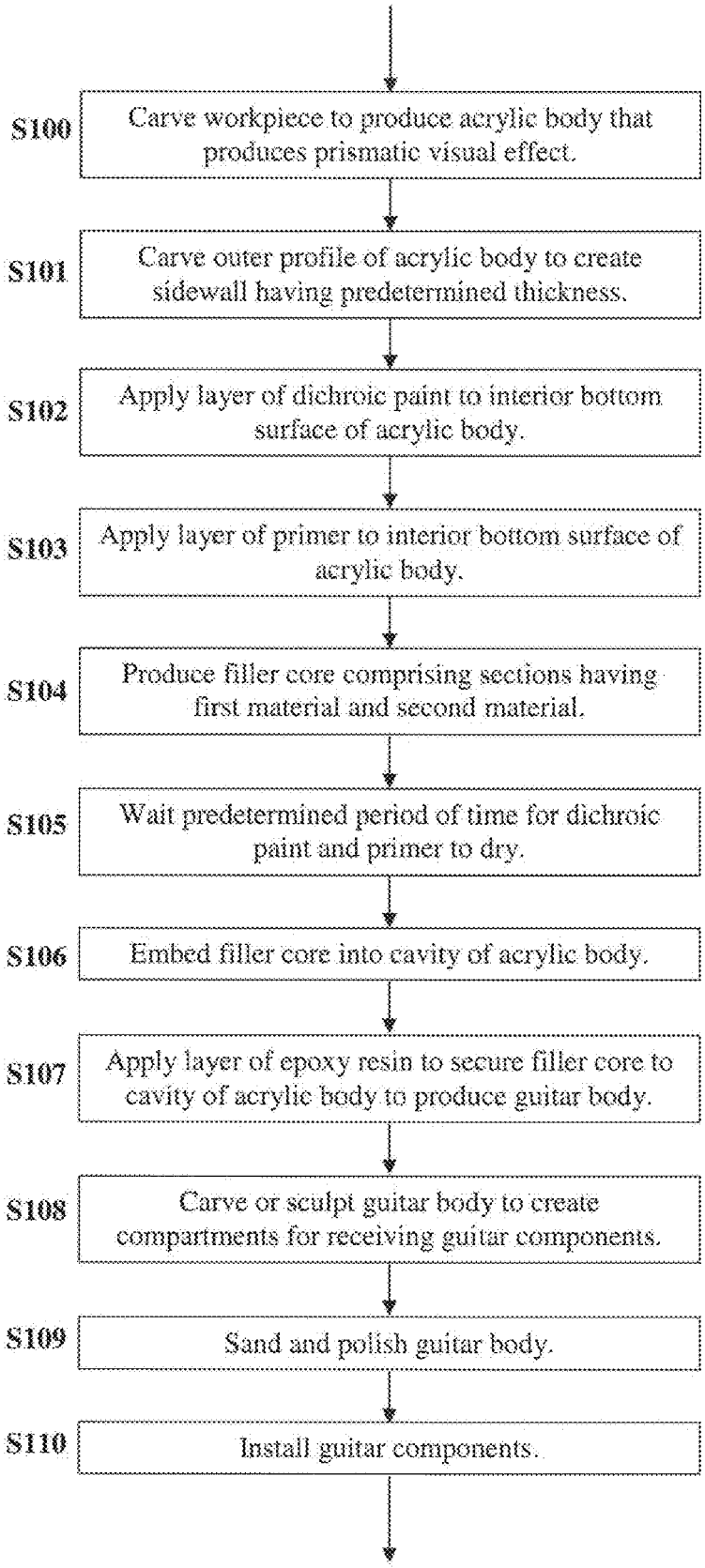
FIG. 1 shows a flow chart of a method for producing a guitar body having a prismatic effect, a lightweight structure and superb sound quality.

In describing preferred embodiments illustrated in the drawings, specific terminology is employed herein for the sake of clarity. However, this disclosure is not intended to be limited to the specific terminology so selected and it is to be understood that each specific element includes all technical equivalents that operate or work in a similar manner. In addition, a detailed description of known functions and configurations are omitted from this specification when it may obscure the inventive aspects described herein, it being understood that certain aspects are clearly understood by those of ordinary skill in the art.

Various tools and methods to facilitate producing a guitar body having a prismatic visual effect are disclosed herein. Methods for producing a table-top end product or another visually appealing device are also disclosed in U.S. application Ser. No. 16/573,690, which was filed on Sep. 17, 2019, by the same inventor and is entitled "PRODUCT HAVING PRISMATIC EFFECT AND METHOD OF PRODUCING THEREOF." The entire contents of U.S. application Ser. No. 16/573,690 (hereinafter "the '690 application") are incorporated herein by reference. It should be appreciated by those skilled in the art that any one or more of such tools or methods may be used to produce a product having a desired and visually distinct prismatic effect and/or in any of various other ways, and thus while various examples are discussed herein, the inventive aspects of this disclosure are not limited to such examples herein. It was discovered by the same inventor of the identified prior-filed application that the product to be visually appealing could be a guitar body and that body could a) be highly visually attractive and b) could produce an excellent sound, while c) not being unwieldly in bulk or weight if made according to the inventive teachings herein.

Referring now to the drawings, wherein like reference numerals designate identical or corresponding parts throughout the several views, FIG. 1 shows a flow chart of the process or method to produce a guitar body for a guitar having a visual prismatic effect and improved sound quality while not being too heavy for extended use, according to an exemplary embodiment of the present invention.

Figure 2:
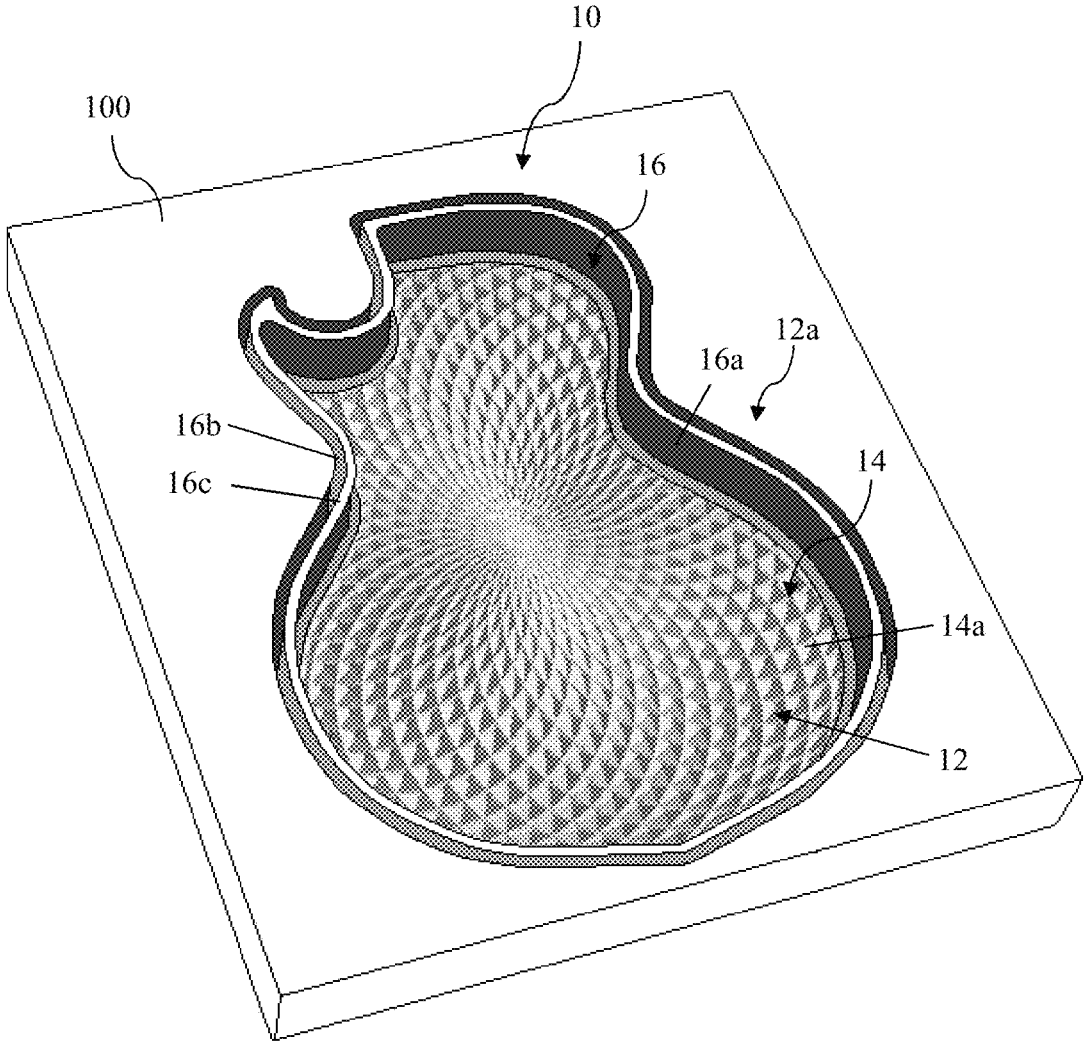
FIG. 2 shows an acrylic starting workpiece having a guitar body carved out from within and showing the inside of the front of the guitar base after it has been carved or cut with a multiple of small, geometric cavities.

FIG. 2 shows a planar, preferably acrylic, workpiece 100 intended to be shaped by machining into the guitar body 10 for a guitar (e.g., electric or acoustic). The workpiece 100 can be of any perimeter shape or smooth wall contour but, for ease of illustration, a rectangular workpiece with vertical side wall edges is the original work piece having side wall edges perpendicular to one another, as is shown and described. Of course, other shapes can be made. The workpiece 100 may be entirely or substantially composed of poly (methyl methacrylate) (PMMA), also known as acrylic, acrylic glass or plexiglass, which is a transparent thermoplastic that is light weight and shatter resistant. Properties of acrylic are disclosed in the '690 application. In an exemplary embodiment, the workpiece 100 may be cast acrylic, which is formed by casting the monomer, methyl methacrylate, with radical initiators into a form or mold. The workpiece 100 may be substantially transparent such that a person can view objects behind the workpiece 100 (i.e. see-through) without significant distortion. In other words, the original workpiece 100 may allow electromagnetic radiation, such as visible light, to pass through and be substantially undistorted. Some pieces of acrylic have a translucent or filtering effect and that can also form the basis of the workpiece 100.

To create the guitar body 10, the workpiece 100 is carved to produce an acrylic body 12 that can produce a prismatic effect (step S100). The acrylic body 12 includes a cavity 12*a* and a front and basically flat surface 12*b*. For example, as shown in FIG. 2, the acrylic body 12 is substantially in the shape of a guitar body. The cavity 12*a* includes an interior bottom surface 14 and an interior side surface 16*a*. The outer profile of the cavity 12*a* is removed (e.g., cut out) to produce a sidewall 16 having a predetermined thickness (step S101). In an exemplary embodiment, the sidewall 16 constitutes an outer smooth wall profile of the guitar body 10. The sidewall 16 includes an exterior side surface 16*b* and the interior side surface 16*a*. Such removal also leaves a top side edge or surface 16*c* of the sidewall 16. The top edge or side surface 16*c* is connected to edges of the interior side surface 16*a* and the exterior side surface 16*b* such that the top side surface or top edge 16*c* is disposed between the interior side surface 16*a* and the exterior side surface 16*b*. As shown, the exterior side surface 16*b* may form an outer profile of the acrylic body 12. In an exemplary embodiment, the thickness of the sidewall 16 is 6.35 mm and height can be about 12.7 mm. The interior side surface 16*a* and the exterior side surface 16*b* may be smooth even surfaces, while the interior bottom surface 14 may be a rough uneven (but uniform) surface.

The interior bottom surface 14 is carved preferably by a CNC machine with high speed and very accurate cutting heads such that a geometric pattern lending itself to producing a prismatic effect is produced. Conventionally, flat and basically planar pieces of acrylic material do not have a prismatic effect. As stated previously, acrylic material is transparent such that a person can see through acrylic material. As such, this property of acrylic applies to the workpiece 100 as well in a case in which the workpiece 100 is made entirely or substantially of acrylic. However, by making precise carvings, millings and/or cuts in one or the other flat surface of the workpiece 100 (here they are made into the interior originally flat surface) so as to produce flawless cuts 14*a*, as illustrated in FIG. 2, a prismatic effect can be produced in the area of the substantially flawless cuts 14*a*. In other words, the acrylic workpiece 100 can be transformed to produce a visually appreciative prismatic effect. The flawless cuts 14*a* shown in FIG. 2 are merely exemplary. As such, the flawless cuts 14*a* may be in any individual shape and/or collectively that causes the interior bottom surface 14 to produce a prismatic effect. Here, each scut is an inverted pyramid and the pyramids are adjacent to one another in an arc or circular configuration. A skilled artisan would recognize that the flawless cuts 14*a* may include various cross-sections (square-shaped, rectangle-shaped, inverted pyramids, etc.). A single workpiece 100 can have one or more of these flawless cuts 14*a* alone or in combination. More information regarding the process for producing a prismatic effect is disclosed in the '690 application.

The flawless cuts 14*a* may be made by a cutting head (or a milling machine, boring tools, lathes, etc.), which is a tool used for precisely removing material from an object (e.g., a workpiece). Such removal may be performed through 1, 2 and 3 dimensional and rotational movement of a cutting head that is attached to the high speed and movable cutting head in three axis. The cutting head or milling device may be in any shape and/or size and made of any material (e.g., steel, tungsten carbide, etc.). Further, the cutting head may include a sharp cutting tip that cuts away at the workpiece. It is important to the end product's desired "look" that the milling function be an end result of sharp cutting heads, with substantially flawless and clean cuts. In an exemplary embodiment, the milling machine may be pistol-shaped such that, at an end of the "barrel," the selected cutting head can be attached thereto. In another exemplary embodiment, the cutting head may be on a computer numerical control (CNC) machine that modifies the workpiece according to instructions or inputs into a computer connected to the CNC machine. As such, a workpiece can be modified through automation by instructions from a computer into the CNC machine. Cutting heads will mill the acrylic base to produce a workpiece 10 with many substantially flawless cuts being made into one of the planar surfaces. Preferably, the cuts are made with a high speed milling machine or by hand, but the precision of the CNC milling machine is highly preferable to the end product's highly artistic and uniform aesthetic look. Alternatively, a device similar to a 3-D printer can be used with acrylic to add material to a planar surface to thereby produce one or more precision cuts into one and/or the other of the opposed planar surfaces.

A motor included in the milling or CNC machine that is powered by a battery or an electrical outlet (via an attached cable/plug combination) causes rotational and generally high speed movement to the cutting head. The spindle speed, rotation speed or revolutions per minute (RPM) may be calculated based on the frequency of rotation around an axis. In this case, the axis is considered to be concentric with the barrel of the cutting head. For example, the cutting head may have RPM in the following range: 200 RPM-25,000 RPM. Other parameters, such as feed rate, may also be utilized or programmed as instruction for the CNC machine. Feed rate is the velocity at which the cutting tip of the cutting head is advanced against the workpiece. More specifically, feed rate is the distance the cutting tip has travelled during one revolution. For example, feed rate can be measured in inches per minute. By having the cutting heads which are undulled and sharp, cutting at the current feed rate, cutting at the correct RPM and providing lubrications or lack thereof, the flawless cuts can be achieved such that a prismatic visual effect is produced into the workpiece. For example, cutting or milling (without any lubricant) at a spindle speed (rotation speed) in the range of 9,000-18,000 RPM with a feed rate of advancing acrylic of about 80-120 inches per minute, a stepover half diameter of bit (and creating a final cut depth with a 0.01 inch skim coat) results in a flawless set of cuts that can produce the desired visual prismatic effect. Generally, the cutting head is advanced along one or more of the axes of the workpiece and the cutting head is advanced substantially perpendicular to the planar surface into which the cuts are being made.

Next, according to the preferred embodiment of the invention, a layer of dichroic paint is applied to the interior bottom surface 14 (step S102). Dichroic paint is a coating that undergoes a color change depending on lighting conditions. For example, when viewing a dichroic painted-object from a first direction or angle, the dichroic painted-object may reflect (or display) light having a first color (e.g., green). In contrast, when viewing the same dichroic painted-object from a second direction or angle (that is different from the first direction or angle), the dichroic painted-object may reflect (or display) light having a second distinct color (e.g., pink). As such, dichroic paint is able to display a plurality of colors to a person when he or she views an object painted with dichroic paint from different directions or angles or when light is shone on the object from different directions or angles. This provides a visual effect which is considered highly desirable. More information regarding dichroic paint can be found in the '690 application.

In this arrangement, the dichroic paint layer 12 modifies the prismatic effect produced by the interior bottom surface 14. For example, without the dichroic paint, the interior bottom surface 14 may have produced or reflected a first color set which includes the primary colors of the rainbow (e.g., red, orange, yellow, green, blue, indigo, violet). However, in the case that the interior bottom surface 14 is coated with and thus includes the dichroic paint layer, even more colors can be generated and seen. For example, the dichroic-painted interior bottom surface 14 may produce or reflect a second color set. Such second color set may include hues, tints or shades of the primary colors or may produce colors that include, but are not limited to, pink, gold, vermilion, cinnabar, dandelion, teal, olive, cerulean, saffron, lavender, cyan, magenta, etc. An example of a portion of the colors in the second color set is reflected in the '690 application.

As such, white light may enter the flawless cut 14*a* via the exterior surface of the body. As the white light enters inside the acrylic body 12, the white light becomes modified light by interacting with the walls of the cuts, in a manner similar to that of how a prism breaks up white light into its constituent colors. Next, the modified light may reach the dichroic coating layer. Once the modified light reaches the dichroic coating layer of paint, the modified light may be reflected, such that the modified light exits the acrylic body 12 as one of the colors in the second color set. As such, the color of the light exiting the acrylic body 12 (after being reflected by the dichroic paint layer) is dependent on the angle in which the white light (corresponding to the exiting light) originally entered the interior bottom surface 14. Thus, a person (i.e. viewer) viewing the acrylic body 12 may view different colors depending on the angle from which he or she is viewing the acrylic body 12. In one exemplary embodiment, the first color set and the second color set may include colors that are exclusive to each other. In another exemplary embodiment, there may be at least one color that is present in both the first color set and the second color set. In yet another exemplary embodiment, the shape or size of the flawless cuts 14*a* can have an effect on the type of colors that are produced by the acrylic body 12 with the dichroic painted layer (and an applied primer layer) as described below.

After the dichroic paint has been applied to the interior bottom surface 14, a layer of primer coating is applied to the layer of dichroic paint (step S103). Primer is a coating that is applied to material (e.g., bare metal, sheetrock, wood, etc.) generally before applying the paint to substantially seal the surface and to facilitate the application of the paint in a uniform coat. For example, in conventional usage, primer allows paint (e.g., automobile paint) to better adhere to metal material. Primer is often used in connection with painting sheetrock in homes, too, before paint is applied. In other words, primer can act as a bonding agent to help paint adhere more strongly to another material. Further, primer can also prevent rust and moisture damage to the underlying material. Consequently, when dichroic paint is first applied to the acrylic material and then a layer of primer applied, the primer seems to ensure better adhesion of the dichroic paint to the workpiece, increases the durability of the dichroic paint and provides additional protection for the workpiece. Conventionally, in the process for applying dichroic paint to a workpiece, the primer is generally thought to be applied first, then the dichroic paint and finally a clear or finishing coat. However, here, the acrylic material is first cut, then a layer of dichroic paint applied and then the primer applied over the dichroic paint (as the painting layers are applied to the back surface of the acrylic sheet). More information regarding primer can also be found in the '690 application.

Figure 6:
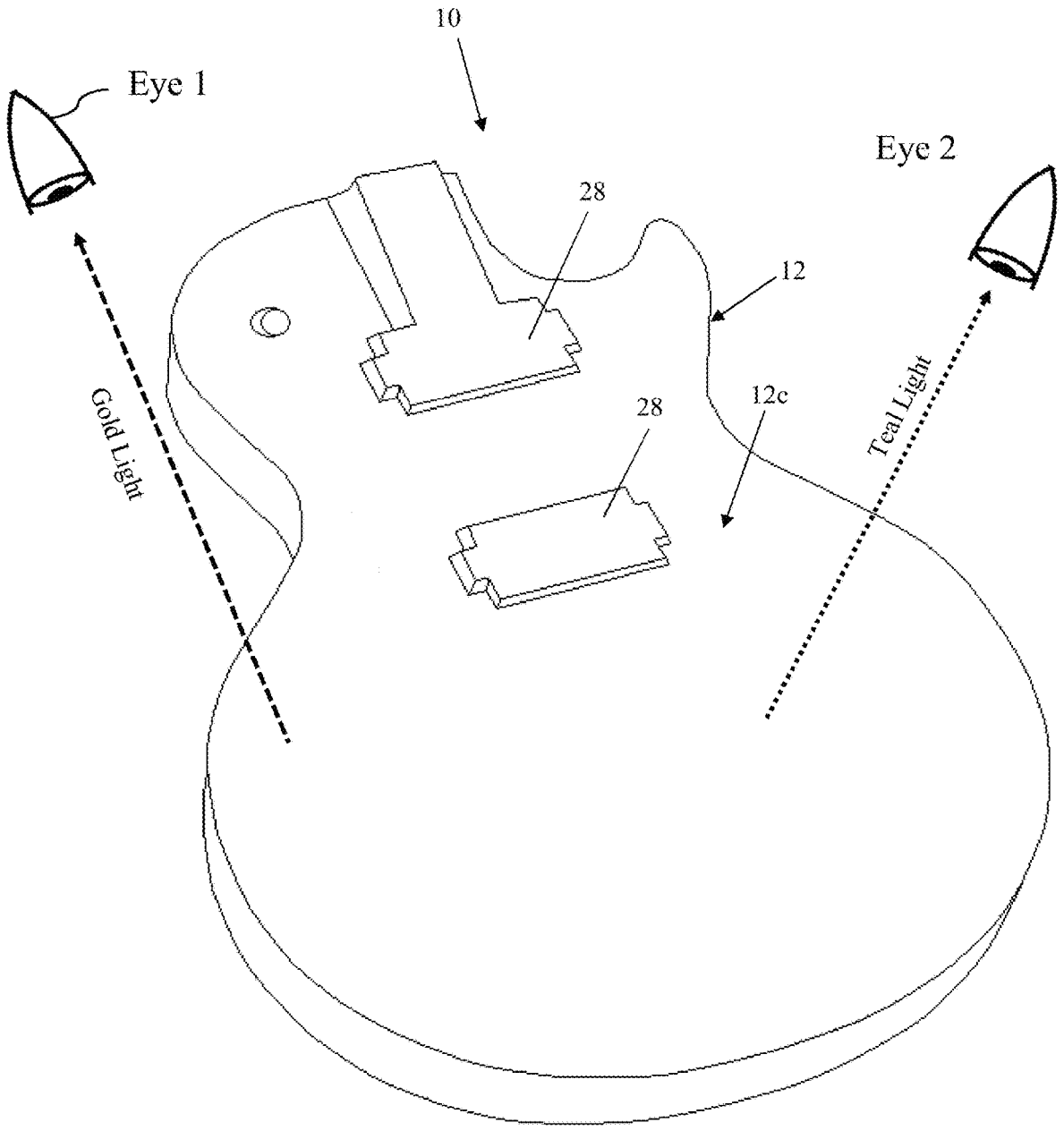
FIG. 6 shows a front surface of the acrylic guitar body molded with traditional or conventional features to hold or attach components of a guitar, e.g., the electric plug, the neck attachment, and the holder for the ends of the strings.

In this arrangement, the primer layer further modifies the prismatic effect produced by the acrylic body 12 and/or the colors produced by the combination of the dichroic paint layer and the flawless cuts 14*a* of the acrylic body 12. For example, the acrylic body 12 may produce or reflect a third color set. Such third distinct color set may include hues, tints or shades of the primary colors or may produce colors that include, but are not limited to, pink, gold, vermilion, cinnabar, dandelion, teal, olive, cerulean, saffron, lavender, cyan, magenta, etc. For example, white light may enter the flawless cuts 14*a* via the front of the guitar body and into the interior bottom surface 14. As the white light enters the acrylic body 12, the white light becomes modified light. Next, the modified light passes through the dichroic coating layer and reaches the primer layer. Once the modified light reaches the primer layer, the modified light may be reflected, such that the modified light exits the acrylic body 12 (exiting towards the front of the body of the guitar) as one of the colors in the third color set. As such, the color of the light exiting the front surface 12*b* of the acrylic body 12 (after being reflected by the primer layer) is dependent on the angle in which the white light (corresponding to the exiting light) originally entered the acrylic body 12. Thus, a person (i.e. viewer) viewing the front surface 12*b* of the acrylic body 12 may view different colors depending on the angle from which he or she is viewing the front surface 12*b* of the acrylic body 12. For example, as shown in FIG. 6, a first viewer having an eye 1 may view, from a first direction (or a first angle), gold light exiting the front surface 12*b* of the acrylic body 12. Similarly, a second viewer having an eye 2 may view, from a second direction (or a second angle), teal light exiting the front surface 12*b* of the acrylic body 12. As such, the colors in the third color set may be determined by at least one of the dichroic paint layer and the primer layer.

In one exemplary embodiment, the first color set, the second color set, and third color set may include colors that are exclusive to each other. In another exemplary embodiment, there may be at least one color that is present in first color set, the second color set, and third color set and/or a combination thereof. In yet another exemplary embodiment, there may be more colors in the third color set than in the second color set, and vice versa. As such, the combination of the primer, the dichroic paint layer and the flawless cuts 14*a* of the acrylic body 12 can produce the visually perceived variety of the aforementioned colors thereby modifying the prismatic effect of the acrylic body 12. It should be noted that the number of colors in the first, second and third color set may not be same as each other. In other words, for example, the number of the colors in the second set may be greater than the number of colors in the first and/or third color sets. More information regarding the effects of dichroic paint and primer can be found in the '690 application.

Figure 3:
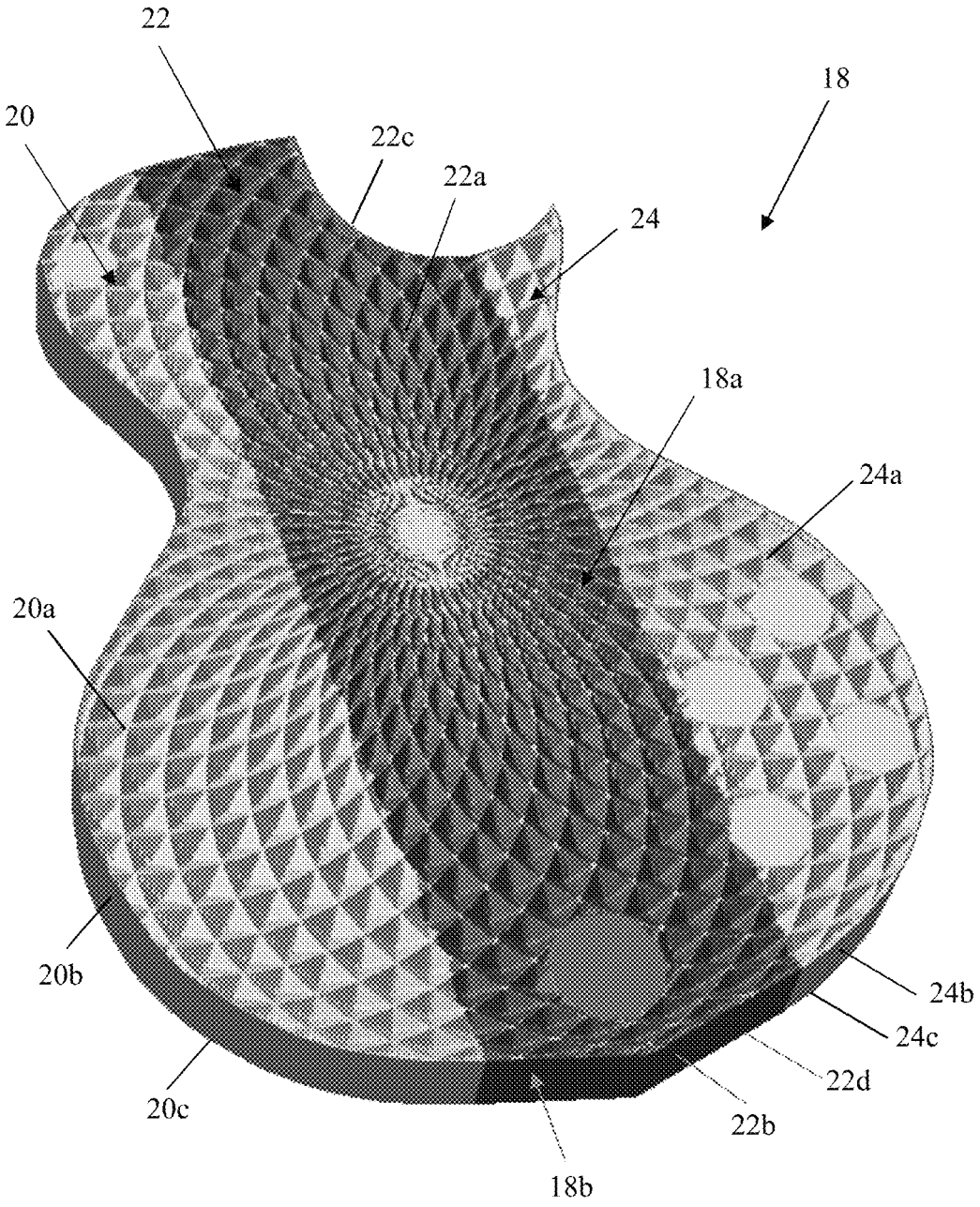
FIG. 3 shows a filler core composed of two distinct materials—the axial component of the filler core (parallel to the neck or strings of the guitar) being formed of a sound absorbing and transmitting wood (a first material which is not sound absorbing) and the distal and curved components of the sides of the guitar being formed of a relative lightweight foam.

Next, a filler core 18 can be produced from one or more materials (step S104), as shown in FIG. 3. For example, the filler core 18 can be carved from the one or more materials by using, for example, a CNC machine. The filler core 18 may be produced and used when the guitar body is configured to be utilized in a solid body electric guitar. An example of the filler core 18 is illustrated in FIG. 3. As shown in FIG. 3, the filler core 18 includes a first section 20, a second section 22 and a third section 24. The second section 22 is disposed between the first section 20 and the third section 24. The first section 20 includes a top surface 20*a*, a side surface 20*b* and a bottom surface 20*c*. The second section 22 includes a top surface 22*a*, a front surface 22*b*, a back surface 22*c* and a bottom surface 22*d*. The third section includes a top surface 24*a*, a side surface 24*b* and a bottom surface 24*c*. The top surfaces 20*a*, 22*a*, 24*a* collectively form a basically co-planar top surface 18*a* of the filler core 18. The side surfaces 20*b*, 24*b*, the front surface 22*b* and the back surface 22*c* collectively form a continuous side wall or side surface 18*b* of the filler core 18. The bottom surfaces 20*c*, 22*d*, 22*c* collectively form a bottom surface 18*c* of the filler core 18. The shape of the filler core 18 conforms to the interior surface structure of the cavity 12 including the interior bottom surface 14*a* and the interior side surface 16*a*. In other words, the filler core 18 is configured to fit or substantially fill the empty space of the cavity 12, such that a guitar body is produced. Because, the interior bottom surface 14 of the guitar body cavity 12 is carved to produce a prismatic effect, the interior bottom surface 14 may be an uneven or rough (but possibly uniform) surface (e.g., having valleys, slopes, etc.). But, it should be appreciated that the top surface of the filler core is the negative mate to the interior surface of the acrylic body such that the filler core will easily mate and fit into the acrylic body of the guitar.

As such, the top surface 20*a* of the first section 20, the top surface 22*a* of the second section 22 and the top surface 24*a* of the third section 24 may each be carved to conform to the surface structure of the interior bottom surface 14 of the acrylic work piece. For example, the combination of the top surfaces 20*a*, 22*a*, 24*a* (i.e. top surface 18*a*) may be an inverted (e.g., negative) surface of the interior bottom surface 14. Such structure allows the top surfaces 20*a*, 22*a*, 24*a* to neatly fit into the interior bottom surface 14. Likewise, the side surface 20*b* of the first section 20, the front surface 22*b* and the back surface 22*c* of the second section 22 and the side surface 24*b* of the third section 24*b* comprise a smooth even surface that conforms to the edge or surface structure of the interior side surface 16*a*. Such structure allows the side surface 20*b*, the front surface 22*b*, the back surface 22*c* and the side surface 24*b* to fit within the interior side surface 16*a*. It should be noted that the bottom surface 20*c* of the first section 20, the bottom surface 22*d* of the second section 22 and the bottom surface 24*c* of the third section 24 are smooth, coplanar and even surfaces.

In one exemplary embodiment, the filler core 18 may be produced using a single material. For example, the filler core 18 may me comprised entirely of a specific tone wood, such as, but not limited to, ash, alder, basswood, ebony, koa, korina maple, mahogany, rosewood, spruce, and walnut. The tonewood selected for use in the filler core 18 may be based on the preference of the manufacture of the guitar and the "ear" of the user. For example, for a wider scope of audible tones, alder may be used, but for a warmer tone, rosewood may be used instead. In another exemplary embodiment, the filler core 18 may be produced using a plurality of materials. For example, each of the sections 22-24 include a different material from each other. As such, the sections 22-24 are initially combined and formed/adhered together, and carved to produce a shape adapted to be fitted into the cavity 12*a* of the acrylic body 12. In another example, the first section 20 and the third section 22 are composed of a material that is different from the material utilized in producing the middle or second section 24. For example, the second section 24 may include a specific tone wood, such as, but not limited to, ash, alder, basswood, ebony, koa, korina, maple, mahogany, rosewood, spruce, and walnut. On the other hand, the first section 20 and the third section 24 may include a lightweight material. An example of lightweight material is foam. Such foam may be compressible or may be a rigid foam, such as polyurethane which is a polymer composed of organic units joined by carbamate (urethane) links. The rigid foam is used for the first section 20 and the third section 24 so as to reduce the weight of the guitar body, and by extension, the entire guitar. In an exemplary embodiment, no less than one-third (⅓) of the volume of the filler core 18 is composed of wood or tone wood. In another exemplary embodiment, the wood component of the filler core 18 runs along the longitudinal axis of the guitar (parallel to the strings) while the foam component is located toward the outside edges of the curves of the guitar body 10. In other exemplary embodiment, the tonal wood extends along the longitudinal axis of the guitar body 10 and the filler core 18 is provided at its distal ends in comparison to the longitudinal axis with foam material. The remaining portion (i.e. two-thirds or less) is composed of lightweight material such as foam or rigid foam. Likewise, sections 22-24 are initially combined together, and carved to produce a shape adapted to be fitted into the cavity 12*a* of the acrylic body 12.

Figure 4:
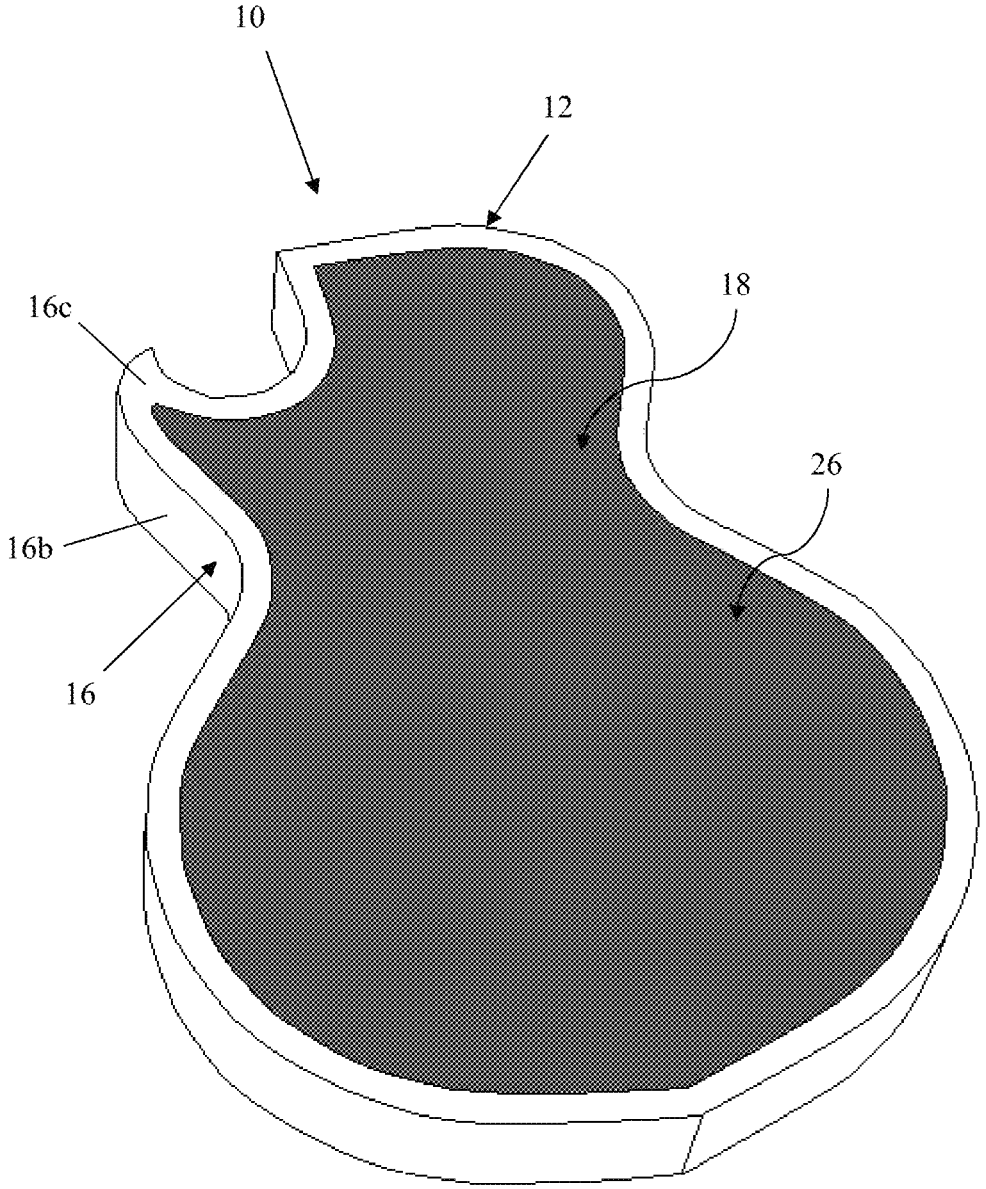
FIG. 4 shows the filler core of FIG. 3 embedded into the cavity of the guitar body shown in FIG. 2 (the outside side wall is a bit exaggerated in FIG. 4 for ease of illustration) and a layer of epoxy resin covering the filler core to secure it in the cavity of the guitar body and to provide a smooth back surface (to be finished) for the guitar body.

After the filler core 18 is produced, the filler core 18 can be slid into and fitted into the guitar body cavity 12*a* to produce a complete structure of the guitar body 10, as shown in FIG. 4. As such, the combination of the filler core 18 and the cavity 12*a* produce a back surface 12*c*. However, before the filler core 18 can be fitted into the cavity 12*a*, a predetermined amount of time (e.g., 24 hours) is waited for the dichroic paint layer and primer layer to dry (step S105). After, such predetermined time has passed, the filler core 18 can be flipped into and embedded into the cavity 12*a* (step S106). As stated previously, due to the structure of the filler core 18, the filler core 18 is adapted to fit neatly into the geometric design of the cavity 12*a*. Thus, top surface 18*a* of the filler core 18 interlocks with the interior bottom surface 14 of the cavity 12*a*. Likewise, the interior side surface 16*a* of the cavity 12*a* becomes and interlocks with side surface 18*b* of the filler core 18. As stated previously, the filler core 18 is fitted into the cavity 12*a* after the dichroic paint and primer dries. For example, such drying process may take twenty-four hours. Next, a layer of epoxy resin 26 is applied to secure the filler core to the cavity of the acrylic body 12 (step S107), as also shown in FIG. 4. More specifically, the layer of epoxy resin 26 is poured over the back surface of the filler core 18 (i.e. bottom surfaces 18*c*) after the filler core 18 has been fitted into the cavity 12*a*. While the filler core 18 fits neatly into the cavity 12*a*, there may be space between the interior side or edge surfaces 16*a* of the cavity 12*a* and the side surface 18*b* of the filler core 18. As such, the epoxy resin 26 may enter (e.g., seep) into such space to secure the filler core within the acrylic body. Once the epoxy resin 26 hardens, the hardened epoxy resin 26 causes the filler core 18 to be permanently attached into the cavity 12*a*. In an exemplary embodiment, the epoxy resin may have a dark color (e.g., black). In another exemplary embodiment, the layer of hardened epoxy resin 26 is configured to be a smooth planar surface. The resin can be provided with an outward bow and can be suitably finished, by sanding, polishing, application of clear coat finishes, etc.

Figure 5:
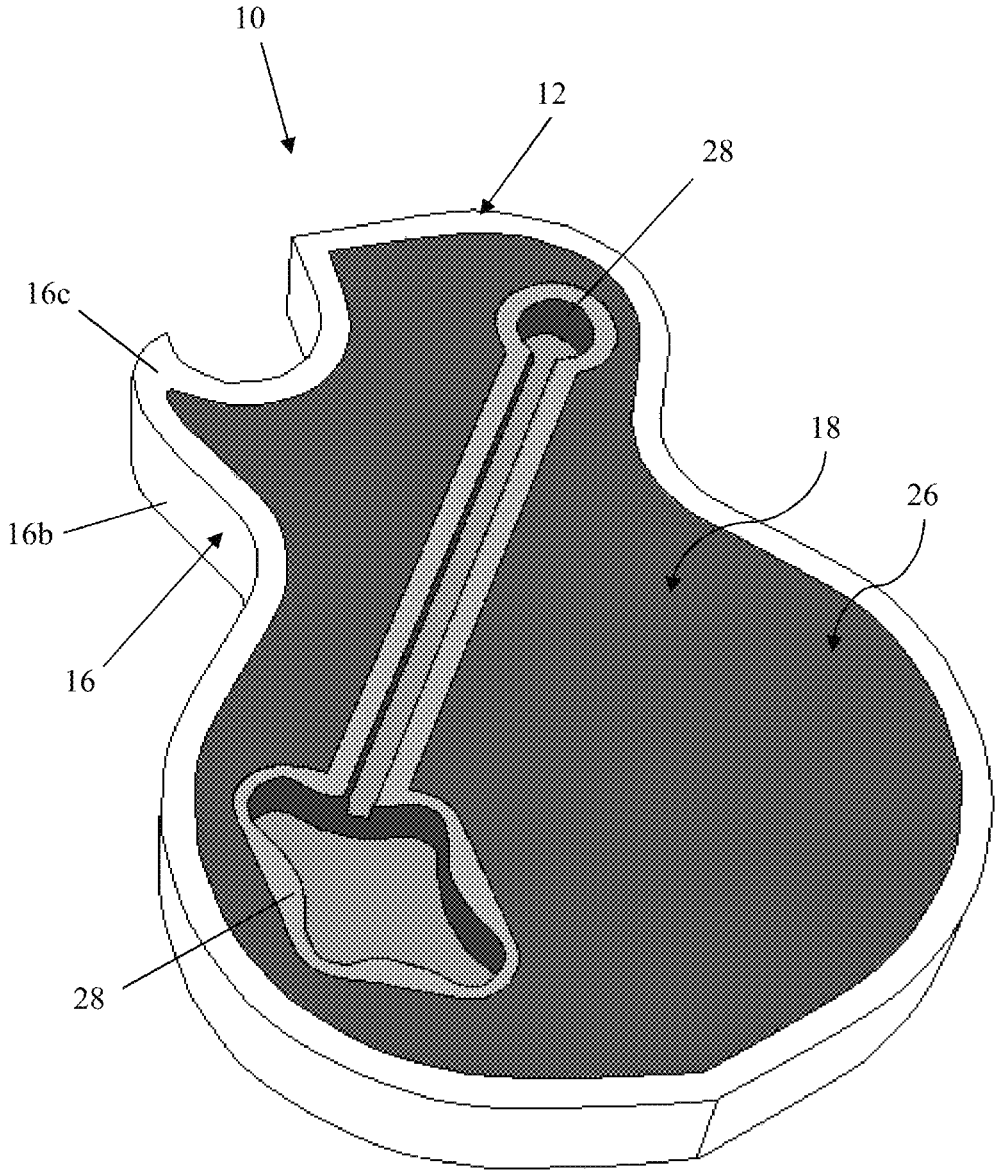
FIG. 5 shows a back surface of the guitar body (the resin filled in and finished surface) carved with compartments configured to hold or attach various components of an electric guitar.

Next, the guitar body 10 is carved to create one or more compartments 28 (step S108), as shown in FIG. 5. Such compartments 28 may hold electric guitar components. The compartments 28 may be independent or connected and any type of chamber, hole or structure that allows components of electric guitar to be held within can be formed. For example, such components may include, but are not limited to, pickups, volume and tone controls, input jack, etc. In one exemplary embodiment, only the back surface 12*c* of the filler core 18 is carved to produce the compartments 28. In another exemplary embodiment, only the second section 22 is carved to produce the compartments 28. In yet another exemplary embodiment, each of the sections 22-24 are carved to produce the compartments 28. The compartments 28 may overlap with at least one of the sections 22-24. Likewise, the front surface 12*b* may also be sculpted (on, for example, the CNC machine) to produce compartments or connections 28 for a neck, pickups, string holders, knobs of the guitar, as shown in FIG. 6. Afterwards, the entire surface of the guitar body 10 is sanded and polished (step S109).

Then, the neck, the hardware and the electronics are installed in the respective compartments 28 (step S110). Acrylic material is known to be heavy. By making such carvings and using a filler core having a lightweight material (e.g., such as rigid foam), the guitar body 10 becomes significantly lighter than if the entire interior of the guitar were made of acrylic. Further, the combination of the filler core and the acrylic material allow a guitar having the guitar body 10 to produce better sound quality. In addition, the prismatic effect of the guitar body 10 is visually appealing. In short, the guitar body 10 is an aesthetically appealing instrument, has great sound quality, and is lightweight.

The aforementioned specific embodiments are illustrative, and many variations can be introduced on these embodiments without departing from the spirit of the disclosure or from the scope of the appended claims. In addition, elements and/or features of different examples, and illustrative embodiments may be combined with each other and/or substituted for each other within the scope of this disclosure and appended claims.

What is claimed is:

1. A prismatic guitar body of a guitar comprising: an acrylic body including: a front surface; and a rearwardly extending cavity including an interior forwardly-facing surface having one or more flawless cuts, wherein layers of dichroic paint and primer are coated on the one or more flawless cuts to produce a prismatic visual effect showing a first distinct set of colors when the front surface is viewed from a first viewing angle and a second and distinct set of colors when the front surface is viewed from a second viewing angle; and a filler core disposed in the cavity of the acrylic body, the filler core comprising a first section including a first material and a second section including a second material that is lightweight.

2. The prismatic guitar body according to claim 1, wherein the acrylic body is in the shape of an acoustic or electric guitar body.

3. The prismatic guitar body according to claim 1, wherein the forwardly projecting surface of the filler core is provided with a negative set of cuts adapted to mate and fit within the flawless cuts of the cavity of the acrylic body.

4. The prismatic guitar body according to claim 1, wherein epoxy resin is coated over a back surface of the filler core.

5. The prismatic guitar body according to claim 4, wherein the acrylic cavity and the filler core are carved into compartments for holding one or more electronic components of an electric guitar.

6. The prismatic guitar body according to claim 5, wherein the entire an exterior surface of the prismatic guitar body is sanded and polished.

7. The prismatic guitar body according to claim 1, wherein the first material and the second material are formed of a same type of wood.

8. The prismatic guitar body according to claim 1, wherein the first material and the second material are comprised of different woods from each other.

9. The prismatic guitar body according to claim 1, wherein the first material of the filler core is wood.

10. The prismatic guitar body according to claim 1, wherein the second material of the filler core is rigid foam.

11. A method for creating a prismatic guitar body of a guitar, the method comprising: (a) providing an acrylic workpiece; (b) carving the workpiece so as to create an acrylic body having a front surface and an interior back surface defining a rear-facing cavity, wherein said interior back surface is carved with a set of one or more substantially flawless geometric cuts substantially extending across said interior back surface; (c) coating at least some of said flawless cuts with a layer of dichroic paint; and (d) coating at least some of the layer of dichroic paint with a layer of primer to produce a prismatic visual effect showing a first distinct set of colors when said front surface is viewed from a first viewing angle and a second and distinct set of colors when said front surface is viewed from a second viewing angle; (e) forming a filler core from one or more sound transmitting materials; and (f) fitting said filler core into said interior back surface.

12. The method according to claim 11, wherein the workpiece is in the shape of an electric or acoustic guitar body.

13. The method according to claim 11, wherein the filler core is a negative mold of the substantially flawless geometric cuts in the interior back surface of said acrylic workpiece.

14. The method according to claim 11, further comprising: (g) coating a layer of epoxy resin over the back surface of said filler core.

15. The method according to claim 14, further comprising: (h) carving at least one of said rear-facing cavity and the filler core to produce one or more compartments for holding components of an electric guitar.

16. The method according to claim 14, further comprising: (i) sanding and polishing said layer of epoxy resin.

17. The method according to claim 11, wherein said filler core is comprised of a first wood material and a distinct second material.

18. The method according to claim 11, wherein the filler core is formed from two sound transmitting materials and said first material is a tonal wood and the second material is a foam material.

19. The method according to claim 18, wherein said tonal wood of said filler core extends along the longitudinal axis of the guitar body.

20. The method according to claim 19, wherein said tonal wood extends along the longitudinal axis of the guitar body and the filler core is provided at its two distal ends with foam material.

* * * * *